US011215938B2

(12) United States Patent
Hasegawa et al.

(10) Patent No.: US 11,215,938 B2
(45) Date of Patent: Jan. 4, 2022

(54) OPTICAL WRITING DEVICE

(71) Applicant: Konica Minolta, Inc., Tokyo (JP)

(72) Inventors: Ryo Hasegawa, Hachioji (JP); Takahiro Matsuo, Toyokawa (JP); Hajime Taniguchi, Toyokawa (JP); Atsushi Nagaoka, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/735,772

(22) Filed: Jan. 7, 2020

(65) Prior Publication Data

US 2020/0241440 A1 Jul. 30, 2020

(30) Foreign Application Priority Data

Jan. 24, 2019 (JP) ..... JP2019-010224

(51) Int. Cl.
*G03G 15/04* (2006.01)
*G03G 15/043* (2006.01)

(52) U.S. Cl.
CPC ... *G03G 15/04063* (2013.01); *G03G 15/0435* (2013.01); *G03G 2215/0412* (2013.01)

(58) Field of Classification Search
CPC ..... B41J 2/451; B41J 2/45; G03G 15/326; G03G 15/04072; G03G 2215/0409; G03G 15/043; G03G 15/04054
See application file for complete search history.

(56) References Cited

U.S. PATENT DOCUMENTS 5,745,152 A * 4/1998 Vincent ..... B41J 2/45 347/238
2008/0187362 A1* 8/2008 Inoue ..... B41J 2/451 399/221
2009/0160926 A1* 6/2009 Tsujino ..... G03G 15/043 347/135
2009/0190228 A1* 7/2009 Koizumi ..... B41J 2/451 359/619
2010/0220375 A1* 9/2010 Yamamura ..... H04N 1/0315 359/227

FOREIGN PATENT DOCUMENTS

JP 2004074515 A 3/2004

* cited by examiner

*Primary Examiner* — Walter L Lindsay, Jr.
*Assistant Examiner* — Jessica L Eley
(74) *Attorney, Agent, or Firm* — Buchanan Ingersoll & Rooney PC

(57) ABSTRACT

An optical writing device includes: an image carrier; an exposer that exposes a curved surface of the image carrier; and a control circuit that controls the exposer, wherein the exposer includes a plurality of light-emitting element groups having different positional relationships from one another with the image carrier, and has a configuration that is adjusted in accordance with at least one of an angle at which light reaching the curved surface of the image carrier from each light-emitting element group enters the image carrier, and a distance of each light-emitting element group from the image carrier.

13 Claims, 12 Drawing Sheets

OPTICAL WRITING DEVICE

The entire disclosure of Japanese patent Application No. 2019-010224, filed on Jan. 24, 2019, is incorporated herein by reference in its entirety.

BACKGROUND

Technological Field

The present disclosure relates to an optical writing device, and more particularly, to an optical writing device that optically writes information on an image carrier.

Description of the Related Art

Regarding image forming apparatuses (multi-functional peripherals (MFPs), for example), there are various techniques suggested for writing optical information on an image carrier (a photosensitive member, for example). For example, JP 2004-074515 A discloses a technique for an image forming apparatus that writes information on an image carrier by irradiating the image carrier with light from respective light-emitting elements via a lens. By this technique, the sizes of the respective light-emitting elements vary with distances from the central axis of the lens.

However, the technique described in JP 2004-074515 A does not take into consideration how the light from each light-emitting element forms an image on the image carrier. For example, in a case where the curved surface of the image carrier is irradiated with light from each light-emitting element, there might be cases where the mode of imaging on the image carrier by the light from each light-emitting element will change with the relative positions of the image carrier and each light-emitting element. If the photosensitive mode of the image carrier changes due to a factor other than the data of the image to be formed, the electrostatic latent image formed on the image carrier might deteriorate, which might lead to deterioration of the image formed with the image carrier.

SUMMARY

The present disclosure has been conceived in view of such circumstances, and aims to provide a technology for reducing or preventing deterioration of an electrostatic latent image formed on an image carrier, even if a plurality of light-emitting elements having different positions from one another relative to the image carrier is used.

To achieve the abovementioned object, according to an aspect of the present invention, an optical writing device reflecting one aspect of the present invention comprises: an image carrier, an exposer that exposes a curved surface of the image carrier, and a control circuit that controls the exposer, wherein the exposer includes a plurality of light-emitting element groups having different positional relationships from one another with the image carrier, and has a configuration that is adjusted in accordance with at least one of an angle at which light reaching the curved surface of the image carrier from each light-emitting element group enters the image carrier, and a distance of each light-emitting element group from the image carrier.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
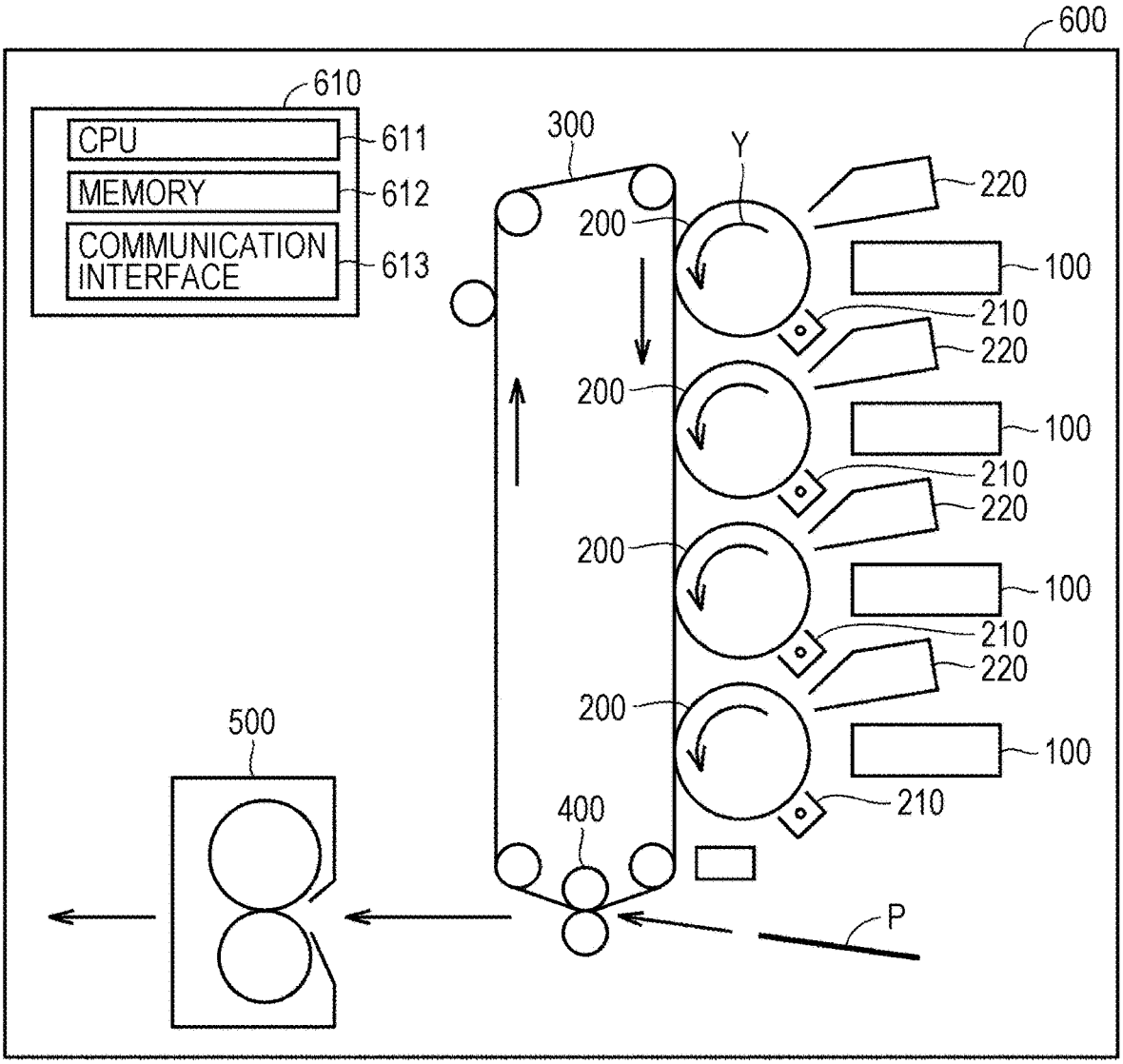
FIG. 1 is a diagram schematically showing the configuration of an image forming apparatus that is an example of an optical writing device.

Hereinafter, one or more embodiments of an optical writing device will be described with reference to the drawings. However, the scope of the invention is not limited to the disclosed embodiments. In the description below, like components and constituent elements are denoted by like reference numerals. Like components and constituent elements also have like names and functions. Therefore, explanation of them will not be unnecessarily repeated.

[1. Configuration of an Optical Writing Device]

FIG. 1 is a diagram schematically showing the configuration of an image forming apparatus that is an example of an optical writing device. An image forming apparatus 600 is a printer or a digital copying machine, for example. As shown in FIG. 1, the image forming apparatus 600 includes: a plurality of optical writing units 100 provided for the respective colors of cyan, magenta, yellow, and black; photosensitive members (image carriers) 200 such as photosensitive drums provided for the respective optical writing units 100; chargers 210 that electrically charge the photosensitive members 200; developing units 220 that visualize electrostatic latent images into images with developers by supplying the developers to the photosensitive members 200 irradiated with light; an intermediate transfer belt 300; a transfer roller (transfer unit) 400 that transfers an image formed with the developers onto a paper sheet P; and a fixing unit 500 that fixes the image formed with the developers transferred by the transfer roller 400 to the paper sheet P.

The image forming apparatus 600 includes a control unit 610. The control unit 610 includes a central processing unit (CPU) 611, a memory 612, and a communication interface 613. The CPU 611 controls operation of the image forming apparatus 600. The memory 612 records various kinds of data including the programs to be executed by the CPU 611. The communication interface 613 is formed with a network card, for example, and communicates with an external device such as a personal computer. In one example, the CPU 611 forms an image on a paper sheet P using elements such as the optical writing units 100, in accordance with a print instruction from an external device.

An outline of an image forming process in the image forming apparatus 600 is now described. Each optical writing unit 100 irradiates the corresponding photosensitive member 200 charged by the charger 210 with light in accordance with an image pattern. As a result, an electrostatic latent image is formed on the photosensitive member 200. When toner is supplied to the electrostatic latent image on the photosensitive member 200 by the developing unit 220, a toner image is formed on the photosensitive member 200. The toner image is transferred onto the intermediate transfer belt 300. In the image forming apparatus 600, the toner image transferred onto the intermediate transfer belt 300 is then pressed against a paper sheet P by the transfer roller 400. As a result, the toner image is transferred onto the paper sheet P. The fixing unit 500 applies heat and pressure to the paper sheet P, to fix the toner image onto the paper sheet P. The paper sheet P is then conveyed by sheet ejection rollers (not shown) or the like, and thus, is output onto a tray (not shown).

Figure 2:
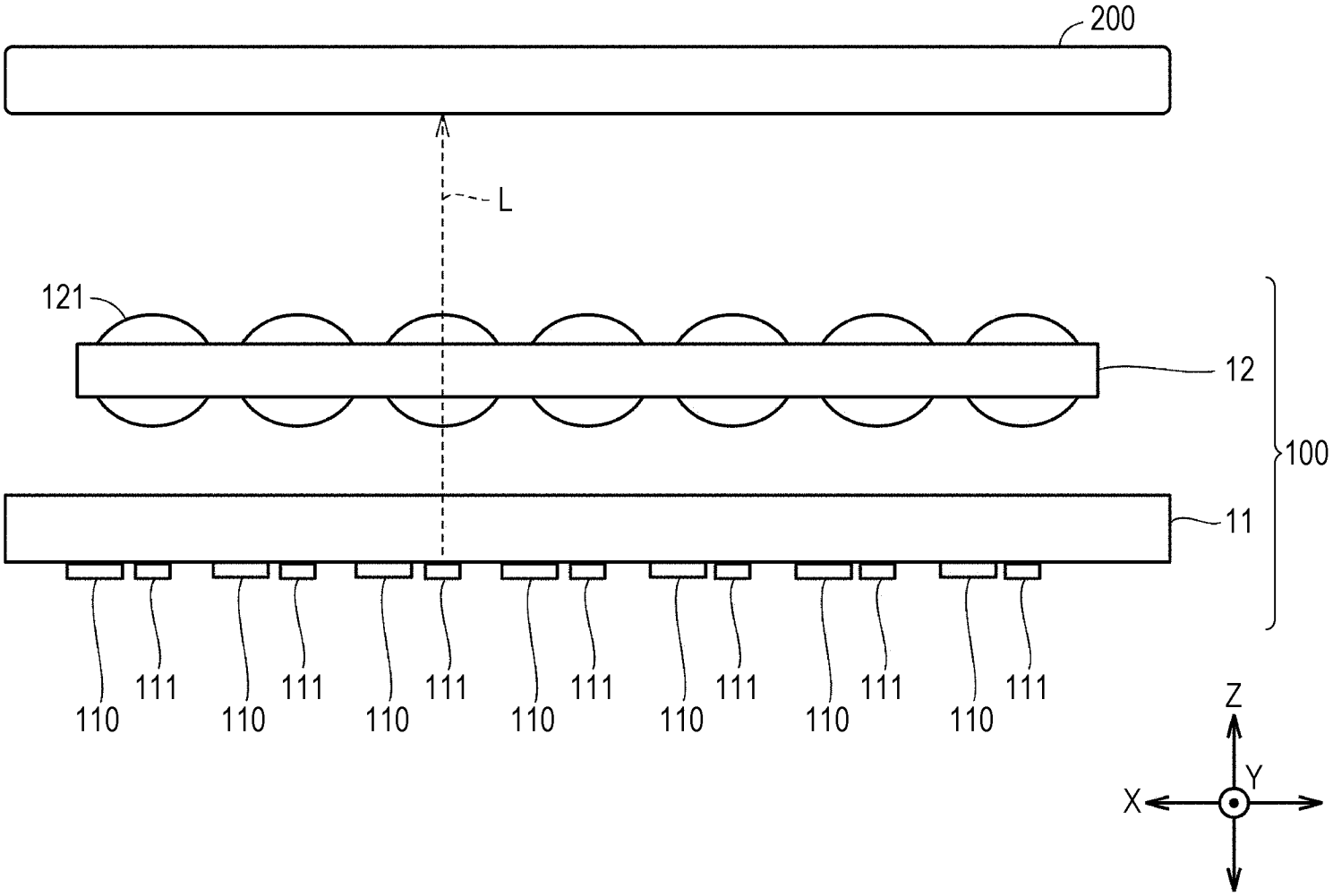
FIG. 2 is an enlarged view of the vicinity of one of the photosensitive members shown in FIG. 1.

FIG. 2 is an enlarged view of the vicinity of one of the photosensitive members 200 shown in FIG. 1. As shown in FIG. 2, the optical writing unit 100 is an example of an exposer, and includes a light-emitting substrate 11 and a lens array 12. The light-emitting substrate 11 includes a plurality of light-emitting element groups 111 and a plurality of control circuits 110. In FIG. 2, the light-emitting element groups 111 and the control circuits 110 are alternately disposed.

Each light-emitting element in the light-emitting element groups 111 is an electroluminescence (EL) element using an organic substance, for example. The light-emitting substrate 11 is formed with glass having a small linear expansion coefficient (such as non-alkali glass). Each control circuit 110 controls each corresponding light-emitting element group 111. The CPU 611 controls each control circuit 110, in accordance with the data of the image to be formed. The lens array 12 includes a plurality of coupling lenses 121. Each light-emitting element group 111 emits light toward the photosensitive member 200 via each corresponding coupling lens 121, as indicated by light L shown in FIG. 2, for example.

In the description below, the following three axes are defined for the photosensitive member 200.

X-axis: the axis extending in the main scanning direction on the photosensitive member 200

Y-axis: the axis extending in the sub scanning direction on the photosensitive member 200

Z-axis: the axis extending in a direction orthogonal to the X-axis and the Y-axis An electrostatic latent image is formed on a surface extending along the X-axis and the Y-axis on the photosensitive member 200, and the photosensitive member 200 rotates in the direction of the Y-axis.

In FIG. 2, the longitudinal direction of the light-emitting substrate 11 and the lens array 12 is parallel to the X-axis direction, and the short-side direction is parallel to the Y-axis direction. In the description below, for the sake of convenience, the lens array 12 is disposed above the light-emitting substrate 11 in the optical writing unit 100.

[2. Pattern of the Plurality of Light-Emitting Element Group]

Figure 3:
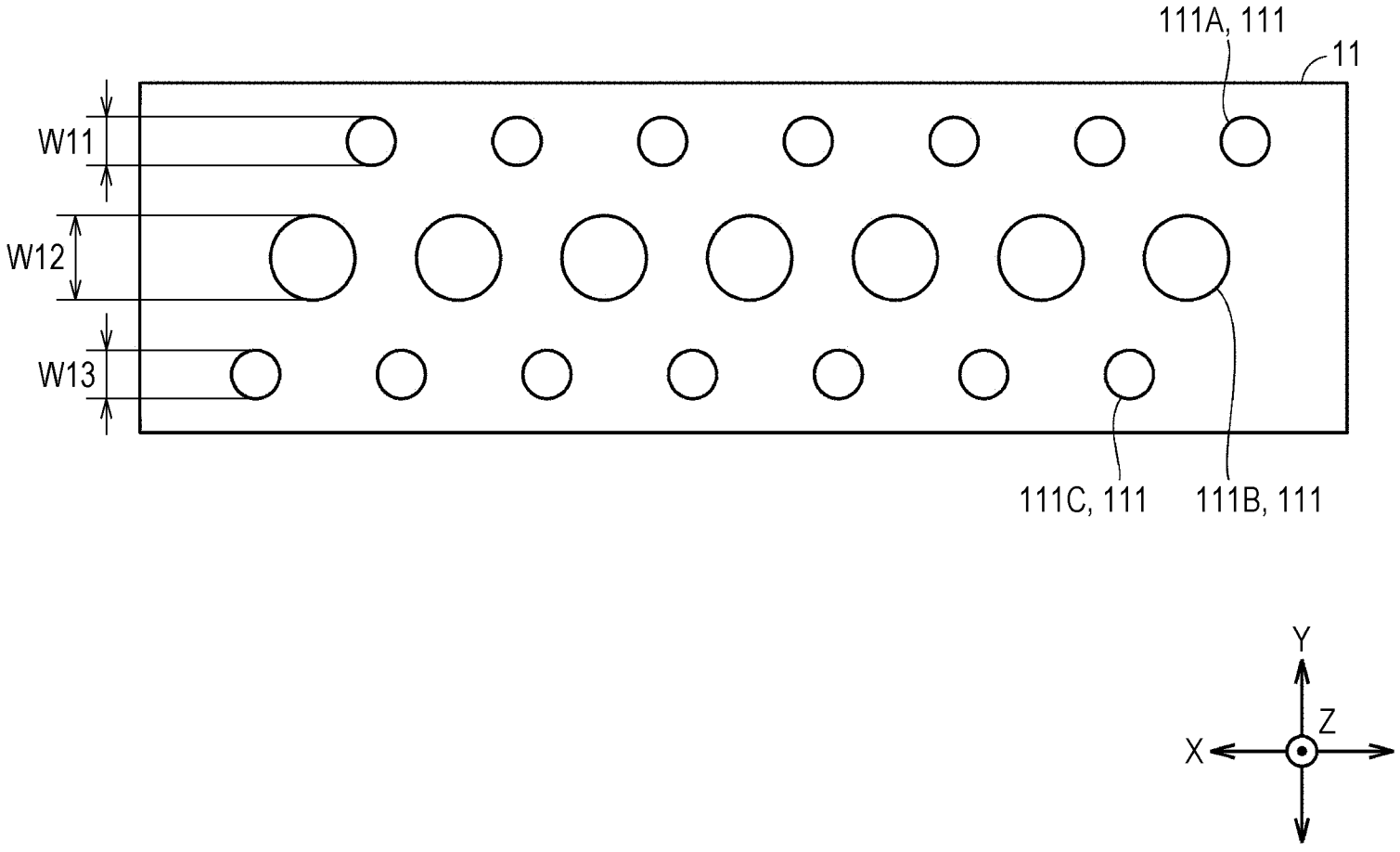
FIG. 3 is a plan view of a light-emitting substrate.

FIG. 3 is a plan view of the light-emitting substrate 11. As shown in FIG. 3, the light-emitting substrate 11 has a substantially rectangular shape. The plurality of light-emitting element groups 111 includes three types of groups (first through third groups) arranged along the X-axis. A first group of light-emitting element groups 111 is shown as light-emitting element groups 111A. A second group of light-emitting element groups 111 is shown as light-emitting element groups 111B. A third group of light-emitting element groups 111 is shown as light-emitting element groups 111C. In each light-emitting element group 111, a plurality of light-emitting elements are arranged to form a substantially circular shape.

The light-emitting element groups 111A, 111B, and 111C in the respective groups have different circle diameters from one another. The diameters of the light-emitting element groups 111A, 111B, and 111C are diameters W11, W12, and W13, respectively.

In the light-emitting substrate 11, the light-emitting element groups 111A, 111B, and 111C are arranged so as to be shifted from one another in the Y-axis direction (the sub scanning direction of the photosensitive member 200). That is, in the light-emitting substrate 11, the light-emitting element groups 111 (the light-emitting element groups 111A, 111B, and 111C) disposed at different positions from one another in the Y-axis direction have different diameters from one another.

[3. Imaging Pattern of Light from Light-Emitting Element Groups]

Figure 4:
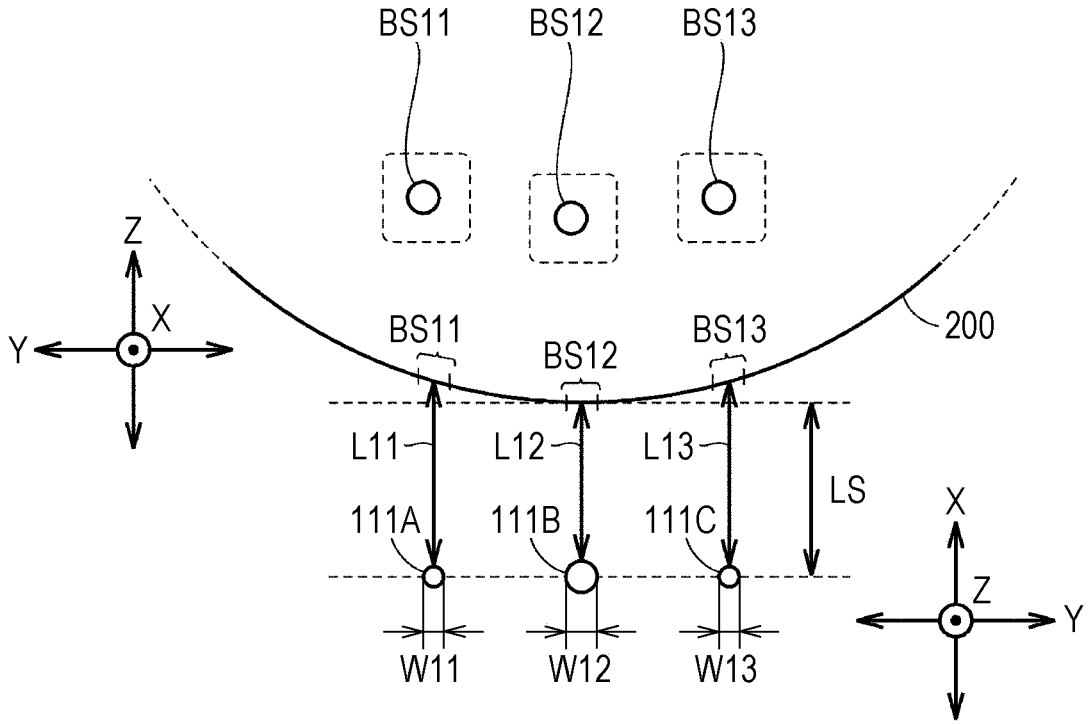
FIG. 4 is a diagram schematically showing image formation of light on a photosensitive member, the light being emitted from light-emitting element groups having different diameters from one another.

FIG. 4 is a diagram schematically showing image formation of light on the photosensitive member 200, the light being emitted from light-emitting element groups 111A through 111C having different diameters from one another.

In FIG. 4, to more clearly explain that the respective light-emitting element groups (the light-emitting element groups 111A through 111C) facing the curved surface of the photosensitive member 200 has different areas from one another on the light-emitting substrate 11, the illustrated orientations of the light-emitting element groups 111A through 111C are different from the illustrated orientation of the photosensitive member 200. That is, in FIG. 4, the photosensitive member 200 is illustrated such that the main scanning direction is a direction that extends through the paper surface, and the light-emitting element groups 111A through 111C are illustrated such that the main scanning direction is a direction parallel to the vertical direction in the drawing. This relationship is the same in FIGS. 6, 10, and 12.

In FIG. 4, each of the light-emitting element groups 111A through 111C emits light toward the curved surface of the photosensitive member 200. Paths L11, L12, and L13 represent the respective paths along the optical axes from the respective light-emitting element groups 111A, 111B, and 111C to the surface of the photosensitive member 200.

The surface of the light-emitting substrate 11 is a flat surface, and the surface of the photosensitive member 200 facing the light-emitting substrate 11 is a curved surface. The light-emitting element group 111B is at a shorter distance in a linear direction from the surface of the photosensitive member 200 than the light-emitting element groups 111A and 111C. That is, the path L11 (a length LS) is shorter than the paths L12 and L13.

FIG. 4 shows images BS11, BS12, and BS13 as images formed on the photosensitive member 200 with the light from the light-emitting element groups 111A, 111B, and 111C. Further, FIG. 4 schematically shows the shapes of the images BS11, BS12, and B13 on the photosensitive member 200.

In the image forming apparatus 600, the diameters W11, W12, and W13 are designed to be smaller when the distance from the light-emitting element groups to the photosensitive member 200 is longer, so that the areas of the images BS11, BS12, and B13 are adjusted to be equal. In other words, the differences in the distance to the surface of the photosensitive member 200 among the light-emitting element groups 111 are complemented by the differences in the area among the light-emitting element groups 111. Accordingly, the light-emitting element groups 111A, 111B, and 111C arranged at different positions in the sub scanning direction of the photosensitive member 200 can expose the curved surface of the photosensitive member 200 in the same manner. Thus, a high resolution can also be maintained in the sub scanning direction of the photosensitive member 200.

In one embodiment of the image forming apparatus 600, the light emission times per unit time (one second, for example) of the respective light-emitting element groups 111A, 111B, and 111C are adjusted to become longer when the respective areas of the light-emitting element groups 111A, 111B, and 111C are smaller. Thus, the differences in the amount of output light per unit time among the light-emitting element groups 111A, 111B, and 111C are reduced.

[4. Modification of the Shape of Light-Emitting Element Groups]

Figure 5:
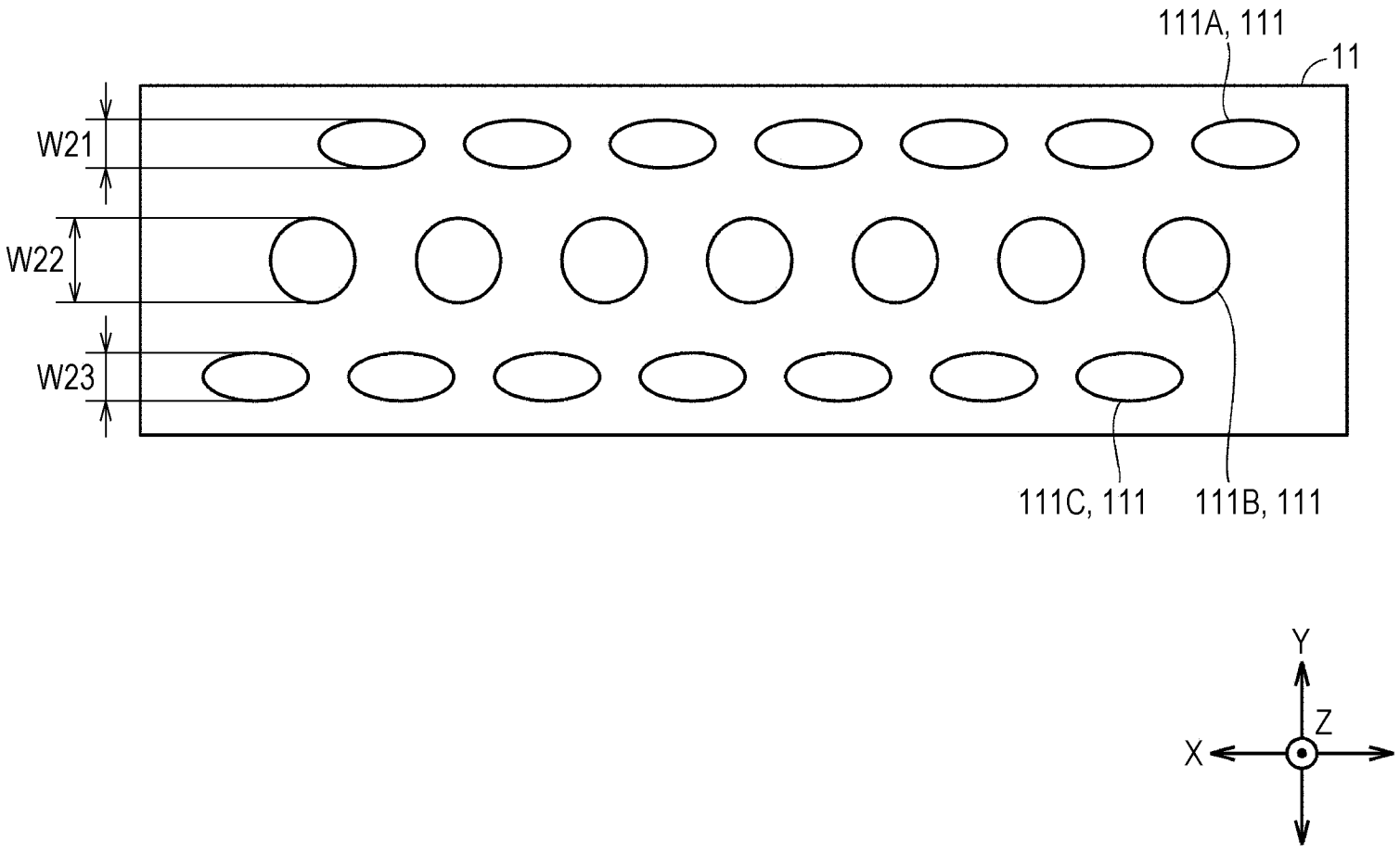
FIG. 5 is a diagram showing a modification of the shapes of the light-emitting element groups.

FIG. 5 is a diagram showing a modification of the shapes of the light-emitting element groups 111A and 111C. In the example shown in FIG. 5, in the light-emitting substrate 11, each of the light-emitting element groups 111A and 111C has an elliptical shape having a short side in the Y-axis direction (the sub scanning direction). The lengths of the short sides of the light-emitting element groups 111A and 111C are shown as lengths W21 and W23, respectively. The light-emitting element group 111B has a circular shape. The diameter of the circular shape is shown as a length W22. The area of each of the light-emitting element groups 111A and 111C is smaller than the area of each light-emitting element group 111B.

Figure 6:
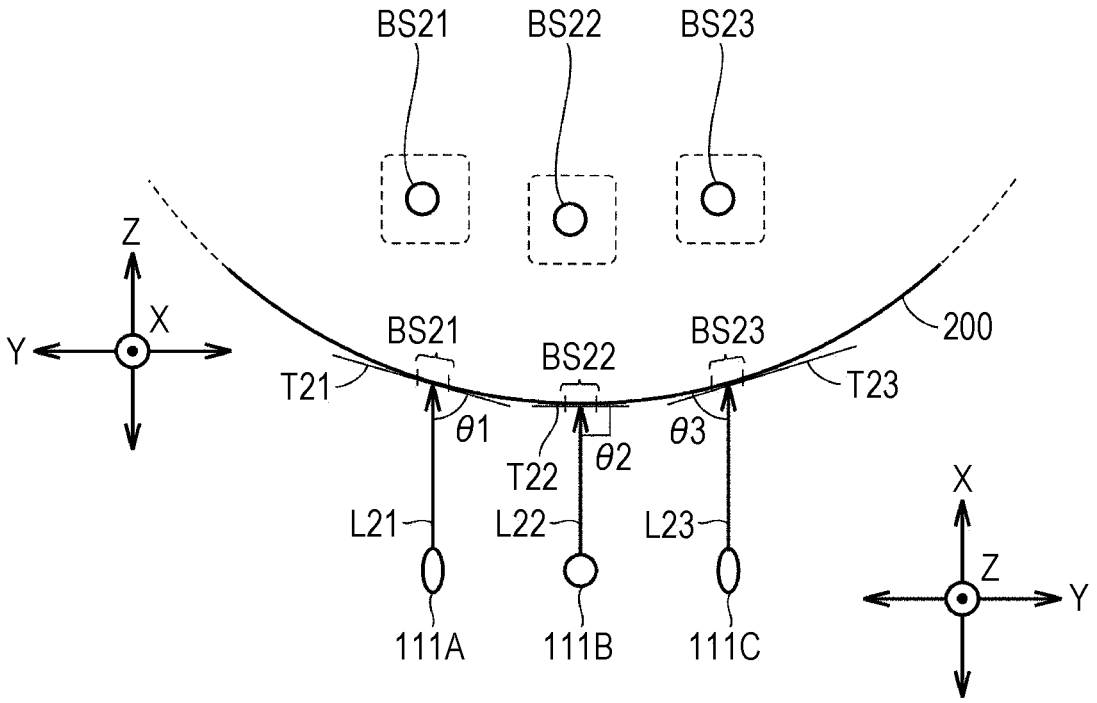
FIG. 6 is a diagram schematically showing a state in which the curved surface of the photosensitive member is exposed by the light-emitting substrate shown in FIG. 5.

FIG. 6 is a diagram schematically showing a state in which the curved surface of the photosensitive member 200 is exposed by the light-emitting substrate 11 shown in FIG. 5. In FIG. 6, paths L21, L22, and L23 represent the respective paths along the optical axes from the respective light-emitting element groups 111A, 111B, and 111C to the surface of the photosensitive member 200. Tangent lines T21, T22, and T23 represent the respective tangent lines on the photosensitive member 200 including the points of intersection between the paths L21, L22, and L23 and the photosensitive member 200. Angles θ1, θ2, and θ3 represents the respective angles between the paths L21, L22, and L23 and the tangent lines T21, T22, and T23. The angles θ1, θ2, and θ3 correspond to the respective incident angles of the light-emitting element groups 111A, 111B, and 111C to the respective photosensitive members 200. The angle θ2 is 90 degrees, and the angles θ1 and θ3 are acute angles.

In FIG. 6, the images formed on the photosensitive member 200 by the light from the light-emitting element groups 111A, 111B, and 111C are schematically shown as images BS21, BS22, and BS23.

The photosensitive member 200 is curved in the Y-axis direction. Each of the light-emitting element groups 111A and 111C has an elliptical shape having a short side in the Y-axis direction. Therefore, the shapes of the images BS21 and BS23 are almost circular, even though the incident angles of light from the light-emitting element groups 111A and 111C are acute angles. That is, the light-emitting element groups are complemented by the differences in size in the sub scanning direction among the light-emitting element groups (the size in the sub scanning direction becomes smaller as the incident angle to the photosensitive member 200 becomes farther from 90 degrees).

As the incident angle to the photosensitive member 200 increases from 90 degrees, the size of an image formed on the photosensitive member 200 in the sub scanning direction becomes larger. Therefore, the size of a light-emitting element group in the sub scanning direction is preferably smaller, where the incident angle of light from the light-emitting element group to the photosensitive member 200 is farther from 90 degrees.

In one embodiment, in the example described above with reference to FIGS. 5 and 6, the control circuit 110 performs adjustment so that the light emission times per unit time of the respective light-emitting element groups 111A, 111B, and 111C become longer when the respective areas of the light-emitting element groups 111A, 111B, and 111C are smaller.

[5. Adjustment of Light from Light-Emitting Element Groups by a Shielder (1)]

Figure 7:
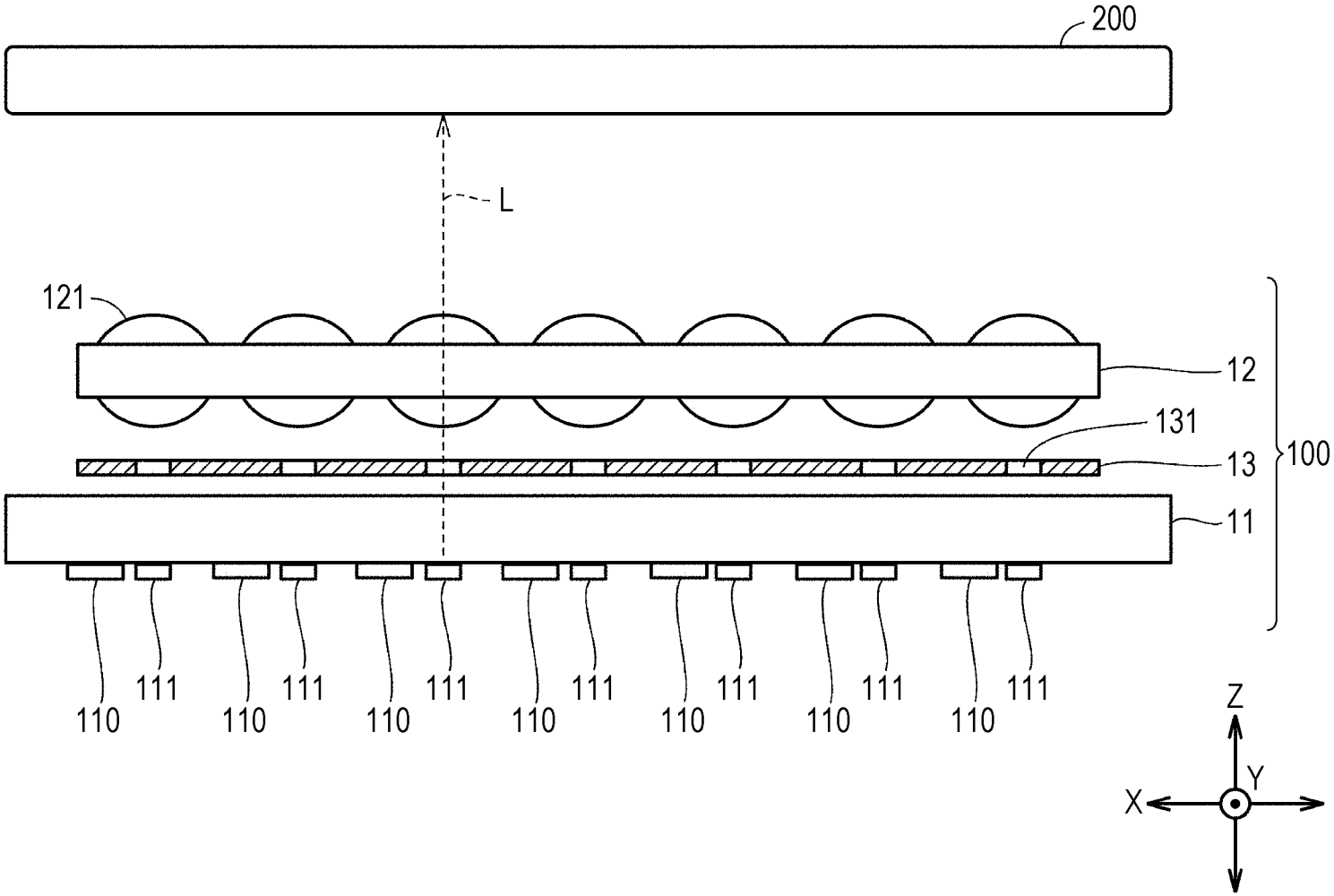
FIG. 7 is an enlarged view of the vicinity of a photosensitive member in a modification of the image forming apparatus.

FIG. 7 is an enlarged view of the vicinity of the photosensitive member 200 in a modification of the image forming apparatus 600. The example shown in FIG. 7 differs from the example shown in FIG. 2 in that the optical writing unit 100 further includes a shielder 13. The shielder 13 is disposed between the light-emitting substrate 11 and the lens array 12.

Figure 8:
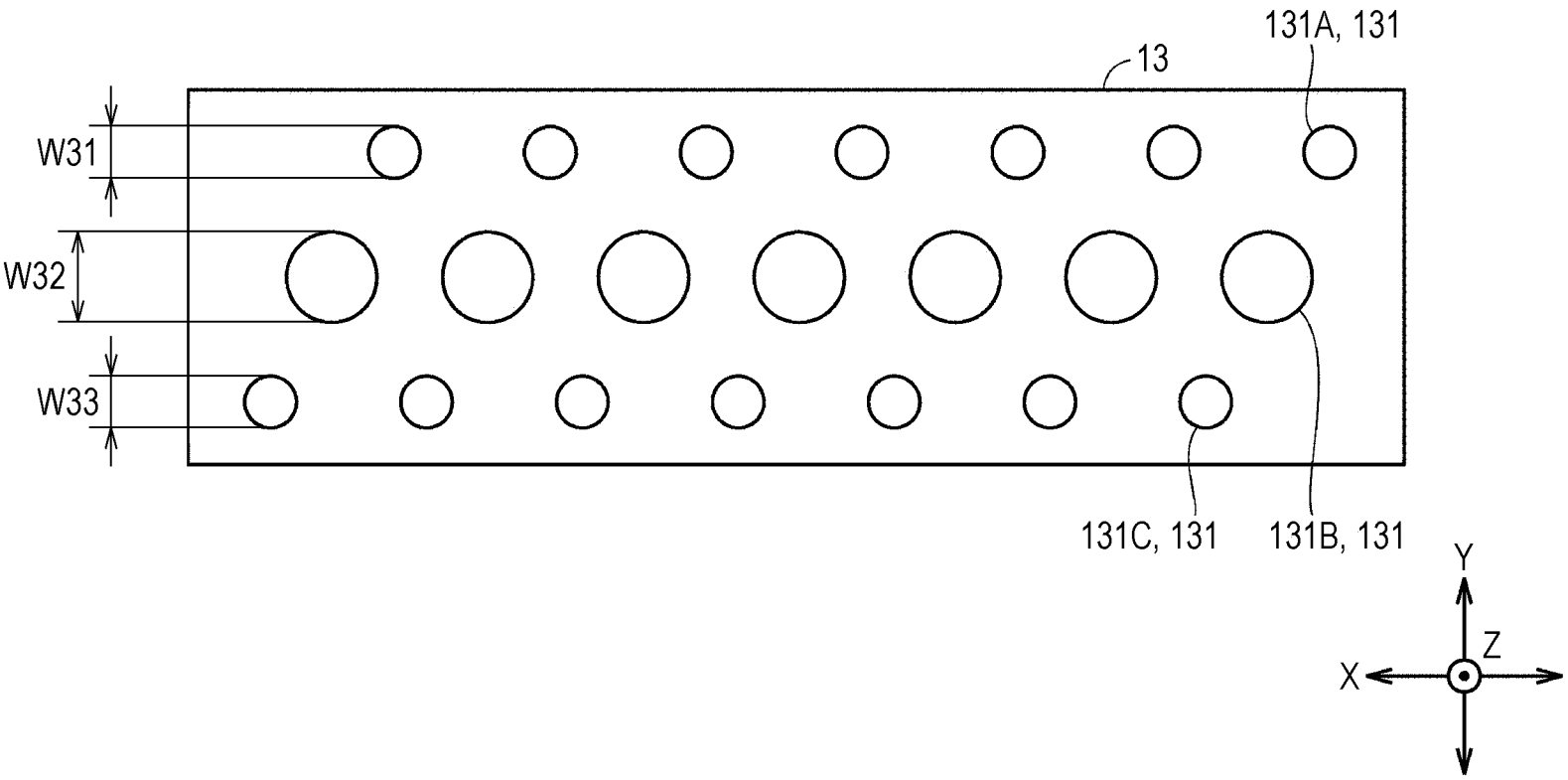
FIG. 8 is a plan view of an example of the shielder shown in FIG. 7.
Figure 9:
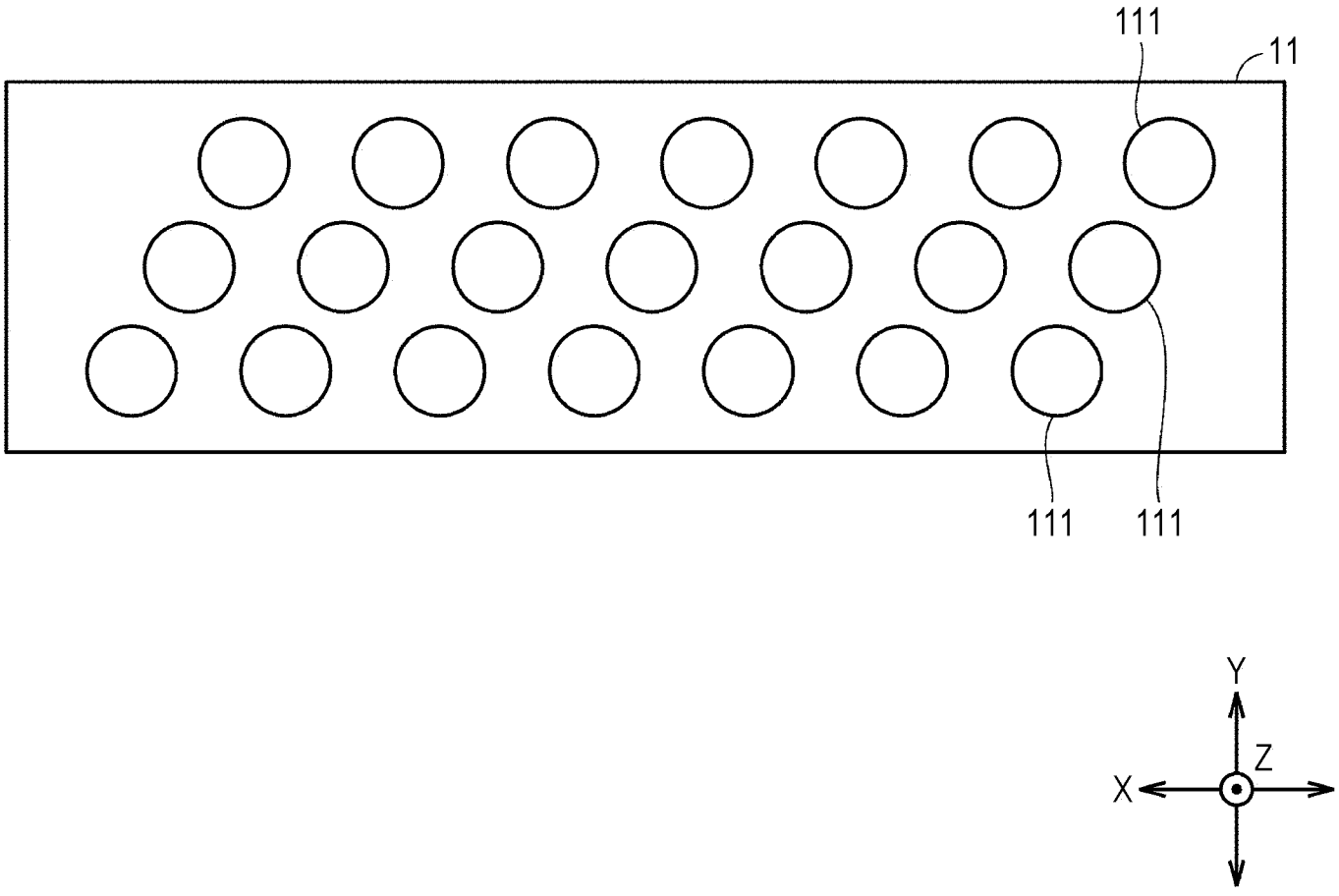
FIG. 9 is a plan view of the light-emitting substrate shown in FIG. 7.

FIG. 8 is a plan view of an example of the shielder 13 shown in FIG. 7. FIG. 9 is a plan view of the light-emitting substrate 11 shown in FIG. 7. In the example shown in FIG. 9, the light-emitting element groups 111 on the light-emitting substrate 11 all have the same shape (circles having the same diameter).

The shielder 13 shown in FIG. 8 has a plurality of circular holes. The holes are arranged in three rows extending along the X-axis. The holes arranged in the first row are shown as holes 131A, the holes arranged in the second row are shown as holes 131B, and the holes arranged in the third row are shown as holes 131C. The lengths of the holes 131A. 131B, and 131C in the Y-axis direction are lengths W31, W32, and W33, respectively.

Figure 10:
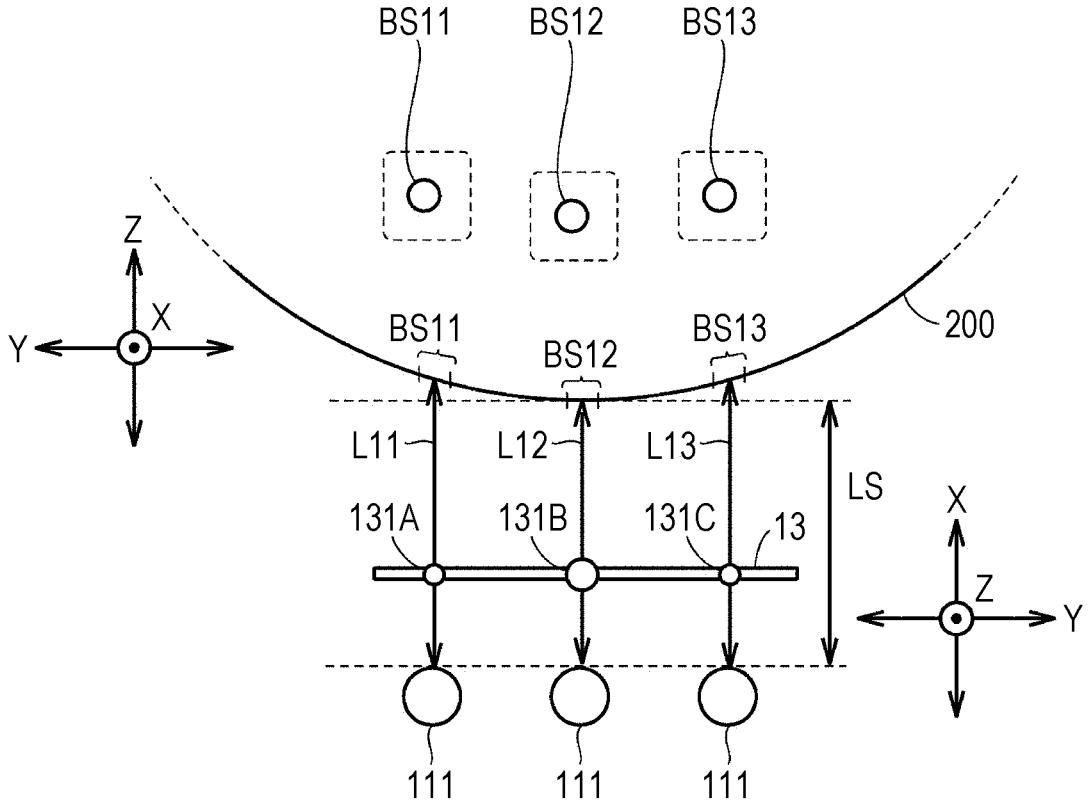
FIG. 10 is a diagram schematically showing images formed on a photosensitive member in an example using the shielder shown in FIG. 8.

FIG. 10 is a diagram schematically showing images formed on the photosensitive member 200 in the example using the shielder 13 shown in FIG. 8. Each hole 131A of the shielder 13 shown in FIG. 8 has such a shape that light from the light-emitting element group 111 forms, on the photosensitive member 200, an image similar to an image formed by light from each light-emitting element group 111A shown in FIG. 3. Each of the holes 131B and 131C has such a shape that light from the light-emitting element group 111 forms, on the photosensitive member 200, an image similar to an image formed by light from each of the light-emitting element groups 111B and 111C shown in FIG. 3. That is, the images BS11, BS12, and BS13 in FIG. 10 are images formed by light through the holes 131A, 131B, and 131C, respectively, and have the same shapes as those of the images BS11, BS12, and BS13 shown in FIG. 4, respectively.

As described above, in the example described with reference to FIGS. 7 through 10, the shielder 13 is employed, so that, even if the light-emitting element groups 111 have the same shape on the light-emitting substrate 11, it is possible to achieve the same effects as those of the example described with reference to FIG. 3 (in which the shapes of the light-emitting element groups are adjusted depending on positions in the sub scanning direction). In one example, the shielder 13 is employed in an existing image forming apparatus in which the light-emitting element groups 11 have the same shape on the light-emitting substrate 11, so that the image forming apparatus functions as an image forming apparatus 600 of this embodiment.

Each of the light-emitting element groups 111 in FIG. 9 may have the same shape as the corresponding hole (one of the holes 131A, 131B, and 131C), or a shape that is wider than the corresponding hole and covers the corresponding hole.

In one embodiment, in the example described with reference to FIGS. 7 through 10, the control circuit 110 performs adjustment so that the light emission times per unit time of the respective light-emitting element groups 111 become longer when the areas of the holes facing the respective light-emitting element groups 111 are smaller.

[6. Adjustment of Light from Light-Emitting Element Groups by a Shielder (2)]

Figure 11:
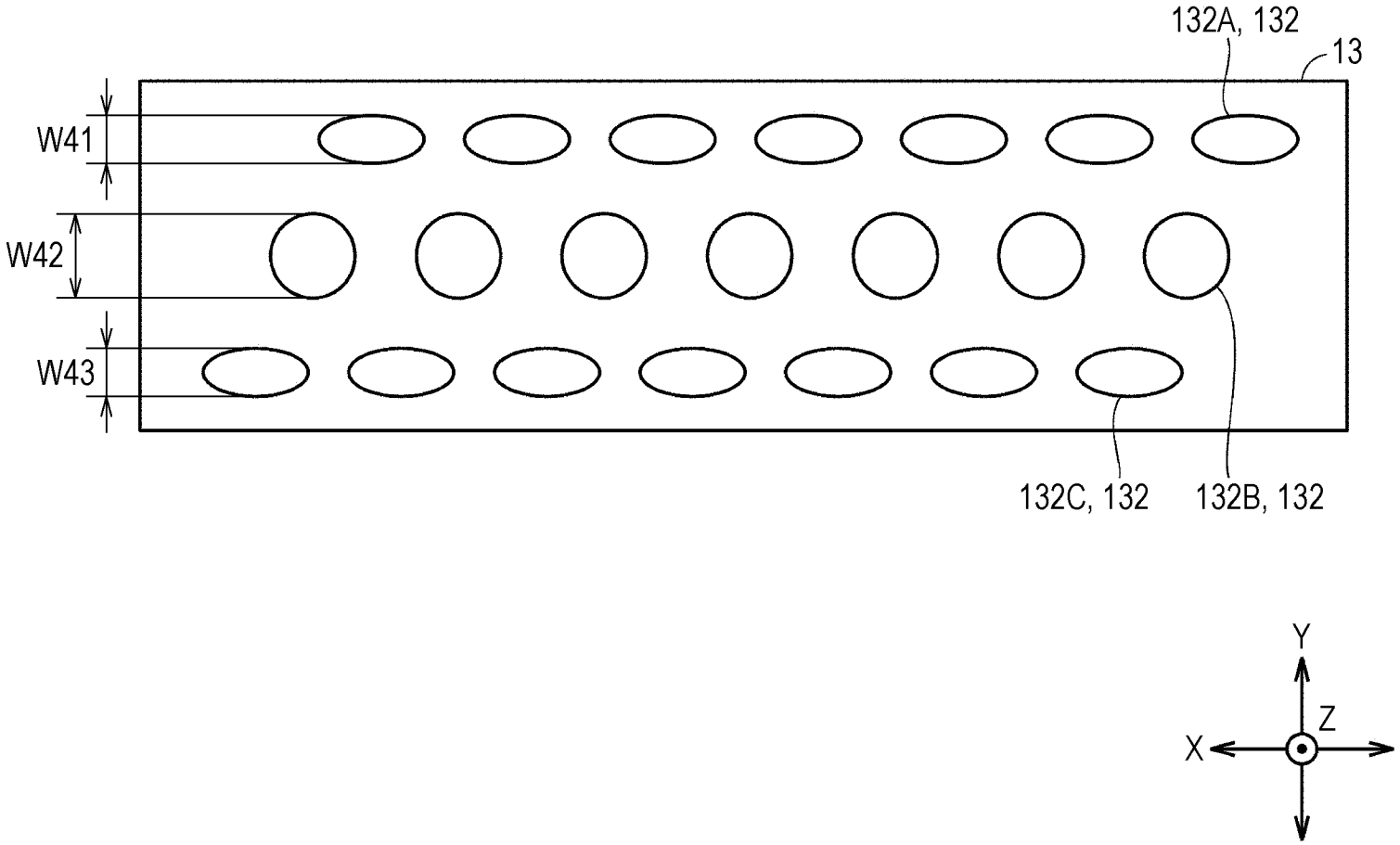
FIG. 11 is a plan view of another example of the shielder shown in FIG. 7.

FIG. 11 is a plan view of another example of the shielder 13 shown in FIG. 7. The shielder 13 shown in FIG. 11 has a plurality of holes. The holes are arranged in three rows extending in the X-axis direction. The holes arranged in the first row are shown as holes 132A, the holes arranged in the second row are shown as holes 132B, and the holes arranged in the third row are shown as holes 132C. The holes 132B each have a circular shape, and the holes 132A and 132C each have an elliptical shape. The lengths of the holes 132A, 132B, and 132C in the Y-axis direction are lengths W41, W42, and W43, respectively.

Figure 12:
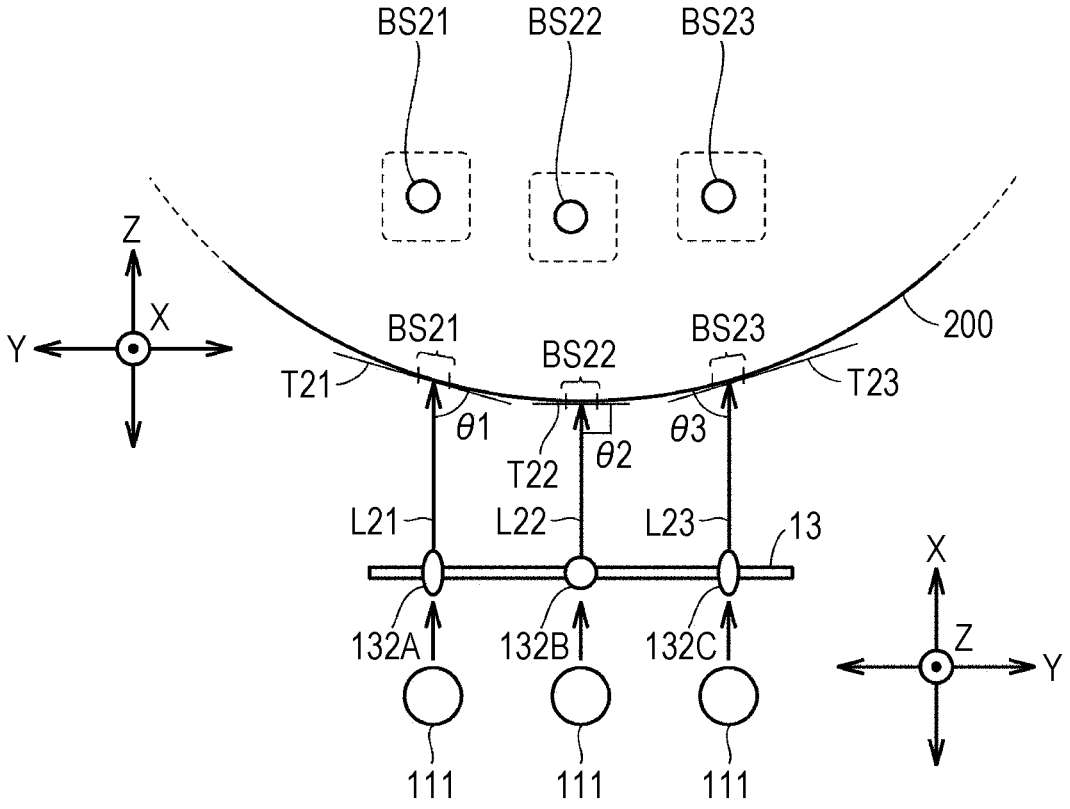
FIG. 12 is a diagram schematically showing images formed on a photosensitive member in an example using the shielder shown in FIG. 11.

FIG. 12 is a diagram schematically showing images formed on the photosensitive member 200 in the example using the shielder 13 shown in FIG. 11. Each hole 132A of the shielder 13 shown in FIG. 11 has such a shape that light from the light-emitting element group 111 forms, on the photosensitive member 200, an image similar to an image formed by light from each light-emitting element group 111A shown in FIG. 5. Each of the holes 132B and 132C has such a shape that light from the light-emitting element group 111 forms, on the photosensitive member 200, an image similar to an image formed by light from each of the light-emitting element groups 111B and 111C shown in FIG. 5. That is, the images BS21, BS22, and BS23 in FIG. 12 are images formed by light through the holes 132A, 132B, and 132C, respectively, and have the same shapes as those of the images BS21, BS22, and BS23 shown in FIG. 6, respectively.

As described above, in the example described with reference to FIGS. 11 and 12, the shielder 13 is employed, so that, even if the light-emitting element groups 111 have the same shape on the light-emitting substrate 11, it is possible to achieve the same effects as those of the example described with reference to FIG. 5 (in which the sizes of the light-emitting element groups in the sub scanning direction are adjusted depending on positions in the sub scanning direction). In one example, the shielder 13 is employed in an existing image forming apparatus in which the light-emitting element groups 111 have the same shape on the light-emitting substrate 11, so that the image forming apparatus functions as an image forming apparatus 600 of this embodiment.

In the example described above with reference to FIGS. 11 and 12, each of the light-emitting element groups 111 in FIG. 9 may also have the same shape as the corresponding hole (one of the holes 132A, 132B, and 132C), or a shape that is wider than the corresponding hole and covers the corresponding hole.

In one embodiment, in the example described with reference to FIGS. 11 and 12, the control circuit 110 performs adjustment so that the light emission times per unit time of the respective light-emitting element groups 111 become longer when the areas of the holes facing the respective light-emitting element groups 111 are smaller.

According to an embodiment of the present disclosure, in an exposer, light reaching the curved surface of an image carrier from each of light-emitting element groups is adjusted in accordance with the angle at which the light from each light-emitting element group enters the curved surface of the image carrier and/or the distance from the image carrier. With this arrangement, it is possible to prevent the photosensitive mode of the image carrier formed with each light-emitting element group from changing due to a factor other than the data of the image to be formed because there is variation in the angle at which the light reaching the curved surface of the image carrier from each light-emitting element group or the distance from the image carrier.

Although embodiments of the present invention have been described and illustrated in detail, the disclosed embodiments are made for purposes of illustration and example only and not limitation. The scope of the present invention should be interpreted by terms of the appended claims, and it should be understood that equivalents of the claimed inventions and all modifications thereof are incorporated herein. Further, the inventions described in the embodiments and the respective modifications are intended to be carried out independently of one another or in combination, wherever possible.

What is claimed is:

1. An optical writing device comprising:

an image carrier;

an exposer that exposes a curved surface of the image carrier; and a control circuit that controls the exposer, wherein the exposer includes a light-emitting arrangement that includes a plurality of light-emitting element combinations, each of the light emitting element combinations includes a light-emitting element group and respective lenses, wherein the light-emitting element groups have different positional relationships from one another with respect to the image carrier, the light-emitting arrangement also optionally includes a shielder having transmissive portions, when included, the shielder is arranged between the plurality of light-emitting element groups and the image carrier, and wherein:

when the light-emitting arrangement includes the shielder, a shape of the transmissive portion of the shielder is determined in accordance with at least one of an angle at which light reaching the curved surface of the image carrier from each light-emitting element group reaches the image carrier, and a distance of each light-emitting element group from the image carrier; and when the light-emitting arrangement does not include the shielder, a shape of the plurality of light-emitting element groups is determined in accordance with at least one of an angle at which light reaching the curved surface of the image carrier from each light-emitting element group reaches the image carrier, and a distance of each light-emitting element group from the image carrier.

2. The optical writing device according to claim 1, wherein, in the exposer, a shape of each light-emitting element group is adjusted to have a smaller area when the light reaching the curved surface of the image carrier from each light-emitting element group enters the image carrier at an angle farther from 90 degrees, or when a distance of each light-emitting element group from the image carrier is longer.

3. The optical writing device according to claim 1, wherein the control circuit performs control to make a light emission time per unit time of each of the light-emitting element groups longer when an area of each light-emitting element group is smaller.

4. The optical writing device according to claim 3, wherein the exposer includes the shielder that regulates the light reaching the curved surface of the image carrier from each of the light-emitting element groups, the transmissive portions pass light from each light-emitting element group through a smaller area when the light reaching the curved surface of the image carrier from each light-emitting element group enters the image carrier at an angle farther from 90 degrees, or when a distance of each light-emitting element group from the image carrier is longer.

5. The optical writing device according to claim 4, wherein the control circuit performs control to make the light emission time per unit time of each of the light-emitting element groups longer when an area of the transmissive portion corresponding to each light-emitting element group is smaller.

6. The optical writing device according to claim 4, wherein the light-emitting element groups all have an identical shape.

7. The optical writing device according to claim 4, wherein each of the light-emitting element groups has the same shape as each corresponding transmissive portion or a shape covering each corresponding transmissive portion.

8. The optical writing device according to claim 1, wherein the configuration of the exposer is set such that an area of an image projected onto the curved surface of the image carrier is substantially the same for all of the light-emitting element groups, regardless of the angle at which light reaches the curved surface of the image carrier from each light-emitting element group.

9. The optical writing device according to claim 1, wherein the configuration of the exposer is set such that an area of an image projected onto the curved surface of the image carrier is substantially the same for all of the light-emitting element groups, regardless of the distance of each light-emitting element group from the image carrier.

10. The optical writing device according to claim 1, wherein, in the exposer, a shape of one of the light-emitting element groups whose light reaches the curved surface of the image carrier at an angle other than 90 degrees is different than a shape of another one of the light-emitting element groups whose light reaches the curved surface of the image carrier at an angle of 90 degrees.

11. The optical writing device according to claim 1, wherein, in the exposer, a shape of one of the light-emitting element groups that has a first distance from the image carrier is different than a shape of another one of the light-emitting element groups that has a distance from the image carrier longer than the first distance.

12. The optical writing device according to claim 1, wherein, in the exposer, a size of one of the light-emitting element groups whose light reaches the curved surface of the image carrier at an angle other than 90 degrees is smaller than a size of another one of the light-emitting element groups whose light reaches the curved surface of the image carrier at an angle of 90 degrees.

13. The optical writing device according to claim 1, wherein, in the exposer, a size of one of the light-emitting element groups that has a first distance from the image carrier is larger than a size of another one of the light-emitting element groups that has a distance from the image carrier longer than the first distance.

* * * * *